US009810035B1

(12) United States Patent
Carr et al.

(10) Patent No.: US 9,810,035 B1
(45) Date of Patent: Nov. 7, 2017

(54) DISPOSABLE SETTING TOOL

(71) Applicant: DIAMONDBACK Industries, Inc., Crowley, TX (US)

(72) Inventors: Jimmy L Carr, Fort Worth, TX (US); Derrek D Drury, Fort Worth, TX (US); Trea H Baker, Granbury, TX (US)

(73) Assignee: Diamondback Industries, Inc., Crowley, TX (US)

( * ) Notice: Subject to any disclaimer, the term of this patent is extended or adjusted under 35 U.S.C. 154(b) by 0 days.

(21) Appl. No.: 15/143,360

(22) Filed: Apr. 29, 2016

(51) Int. Cl.
*E21B 23/06* (2006.01)
*E21B 23/04* (2006.01)

(52) U.S. Cl.
CPC ..... *E21B 23/065* (2013.01); *E21B 23/04* (2013.01)

(58) Field of Classification Search
CPC ..... E21B 23/065; E21B 43/263; E21B 23/04; E21B 29/02; E21B 31/1075; E21B 43/248
USPC ..... 166/63
See application file for complete search history.

(56) References Cited

U.S. PATENT DOCUMENTS 2,618,343 A 11/1952 Conrad
2,713,910 A 7/1955 Baker et al.
3,160,209 A * 12/1964 Bonner ..... E21B 23/065 166/122
5,024,270 A * 6/1991 Bostick ..... E21B 23/065 160/120
7,017,672 B2 3/2006 Owen, Sr.

* cited by examiner

*Primary Examiner* — Taras P Bemko
(74) *Attorney, Agent, or Firm* — Mark W Handley

(57) ABSTRACT

A disposable setting tool (12) has a mandrel (18) and a barrel piston (16). The mandrel (18) has a power charge chamber (68), an intermediate section (76) having an exterior (80) of uniform circumference, and a lower section (96) having a lower exterior (98) of uniform circumference. The lower exterior (98) is in fluid communication with the power charge chamber (68). The barrel piston (16) has a tubular body (116) with an enclosed lower end (134), and a central portion (128) with a uniform interior circumference (130) for slidably receiving the intermediate exterior (80) and the lower exterior (98) of the mandrel (18). An annular-shaped space (94) is defined to extend between the central portion (128) of the barrel piston (16) and the lower exterior (98) of the mandrel (18). The enclosed lower end (134) of the barrel piston (16) has a bore (136) for slidably receiving the lower exterior (98) of said mandrel (18). The mandrel (18) and the piston barrel (16) are adapted for securing to respective ones of a setting sleeve (150) and a packer mandrel (156).

20 Claims, 4 Drawing Sheets

DISPOSABLE SETTING TOOL

TECHNICAL FIELD OF THE INVENTION

The present invention is related to downhole oil tools, and in particular to hydraulic setting tools for setting frac plugs, bridge plugs and packers for sealing well casing.

BACKGROUND OF THE INVENTION

Oil and gas wells are drilled into earth formations, first creating a borehole and then running and cementing casing in the borehole. Well tools such as bridge plugs, packers, cement retainers and frac plugs are often run into cased wells and set using setting tools powered by flammable power charges. Conventional well tools providing well casing sealing assemblies typically comprise a packer having one or more elastomeric sealing elements which are squeezed between a packer mandrel and the casing, and held in place by one more slip assemblies which are wedged between conical sleeves of the packers and the casing. The packers are configured for use as bridge plugs, tubing packers, cement retainers, and frac plugs.

Conventional packer setting tools have been used for setting packers, or well casing sealing assemblies. Conventional setting tools have power charge chambers in which flammable power charges are burned to generate pressurized gases which move one or more pistons to forcibly set the well tool being run within the well. One such setting tool is shown in U.S. Pat. No. 2,618,343 issued to Martin B. Conrad on Nov. 18, 1952. Conventional setting tools use hydraulic oil located between a first piston disposed in a first cylinder and a second piston disposed in a second cylinder. The first piston in the first cylinder is pushed directly by power charge gases and in turn pushes the hydraulic fluid, which then pushes the second piston in the second cylinder. The second piston is then typically connected by a rod and linkage to a setting sleeve for pushing against and setting the well tool in the casing.

The packer mandrels provide a central body on which various components are mounted. The mandrel is attached to a stationary portion of the setting tool and held in a fixed position, and the setting sleeve typically extends around the mandrel and is stroked downward against an uppermost sleeve of the well tool being set. The upper sleeve will then move downward toward a lower end of the mandrel, pushing anchor slips over conical elements and pressing an elastomeric seal element between the mandrel and the casing. During setting of the casing seal device, a shear pin will be sheared to release the setting tool from the set well tool so that the setting tool may be retrieved from the well and be redressed for repeated later use.

SUMMARY OF THE INVENTION

A disposable setting tool is disclosed which is gas operated for setting packers in well casing. The setting tool has a mandrel with an intermediate section and a lower section. The intermediate section has an interior bore which provides a power charge chamber and defines an intermediate exterior of uniform circumference. The lower section has a lower exterior of uniform circumference. The lower exterior of the lower section is in fluid communication with the interior bore of the intermediate section. A barrel piston has a tubular body with an enclosed lower end, a central portion with a uniform interior circumference for slidably receiving the intermediate section and the lower section of said mandrel.

An annular-shaped space is defined to extend between the central portion of the barrel piston and the lower section of the mandrel. The enclosed lower end of the barrel piston has a bore for slidably receiving the lower section of said mandrel. A first seal extends between the barrel piston and the intermediate section of said mandrel for sealing an upper portion of the annular-shaped space. A second seal extends between the bore in the enclosed lower end of the piston body and the lower section of said mandrel for sealing a lower portion of the annular-shaped space. The mandrel has an upper end with a seal section for securing to a firing head. The mandrel and the piston barrel have lowermost ends adapted for securing to respective ones of a setting sleeve and a packer mandrel.

A power charge is disposed in the power charge chamber and ignited to generate pressurized gas and stroke the barrel piston over said lower section of the mandrel, moving the setting sleeve relative to the stationary mandrel and setting a well tool secured thereto. The power charge is dry fired in the disposable setting tool, that is, the setting tool does not use hydraulic fluid such as oil between pistons as does convention setting tool, allowing for disposal of the disposable setting tool without the need to recover oil prior to disposal.

DESCRIPTION OF THE DRAWINGS

For a more complete understanding of the present invention and the advantages thereof, reference is now made to the following description taken in conjunction with the accompanying Drawings in which FIGS. 1 through 5 show various aspects for a disposable setting tool made according to the present invention, as set forth below:

FIG. 1 is perspective view of a well tool string having a disposable setting tool and a fracturing plug type well packer mounted to the setting tool, both shown in run-in positions;

FIG. 4 is an enlarged, partial section view of a mandrel and barrel piston of the disposable setting tool; and FIG. 5 is a longitudinal section view of the disposable setting tool shown in a set position.

DETAILED DESCRIPTION OF THE INVENTION

Figure 1:
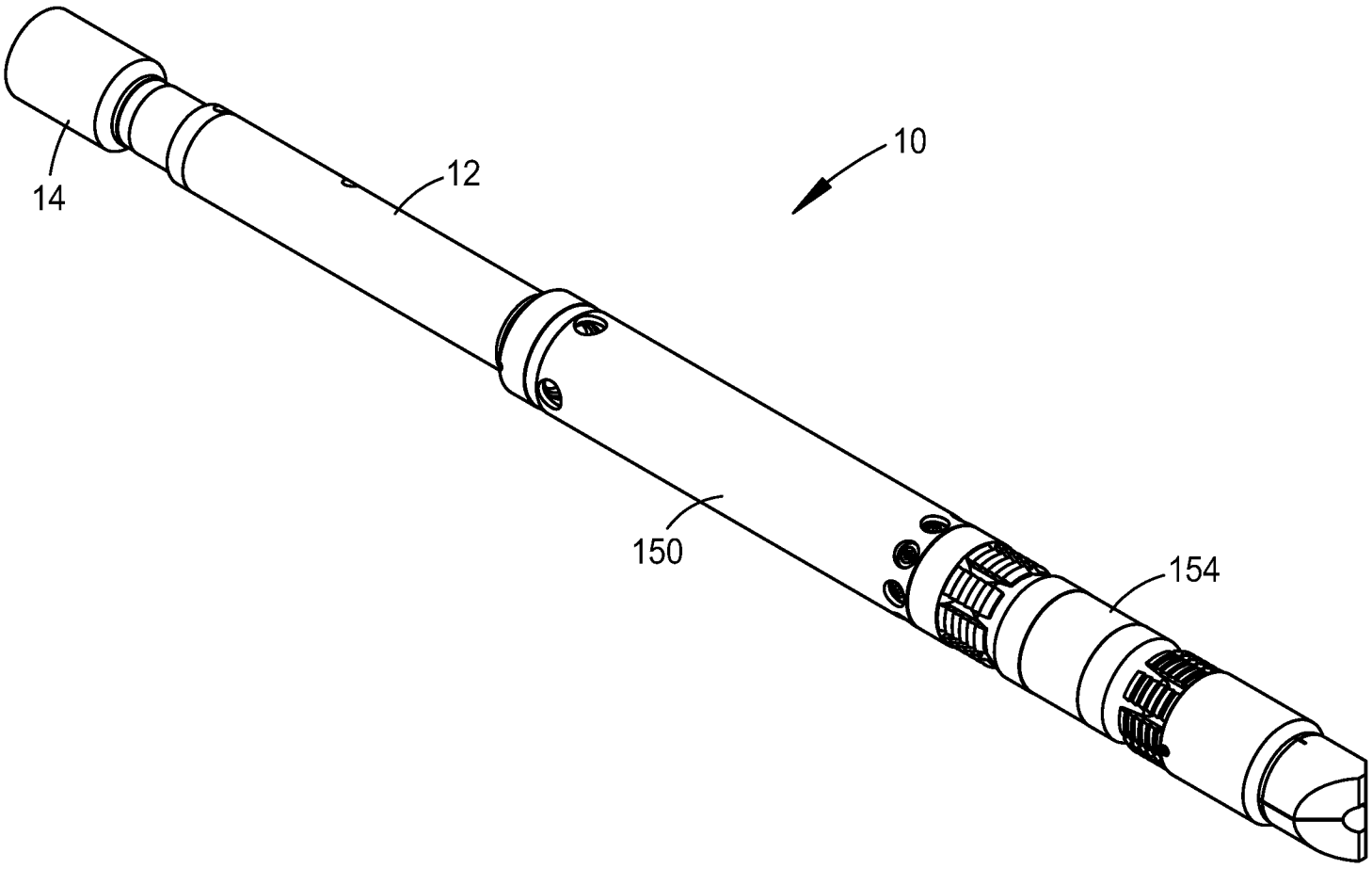

FIG. 1 is a perspective view of a well tool string 10 having a disposable setting tool 12 and a frac plug type well packer 154 mounted to the setting tool 12, both shown in run-in positions. A setting sleeve 150 and the frac plug 154 are secured to the setting tool 10. A firing head adapter 14 is attached to the upper end of the setting tool 12 for receiving a setting tool firing head (not shown). In other embodiments a firing head may be secured directly to the setting tool 12 in place of the firing head adapter 14.

Figure 2A:
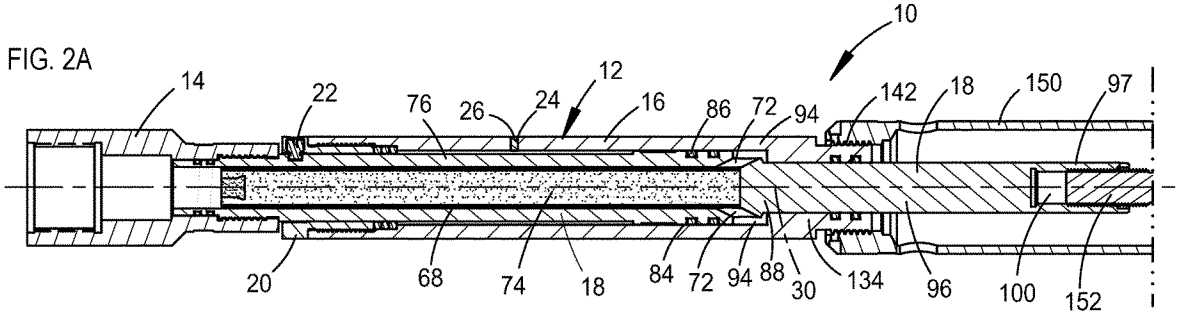
FIGS. 2A and 2B are a longitudinal section view of the well tool string of FIG. 1.
Figure 2B:
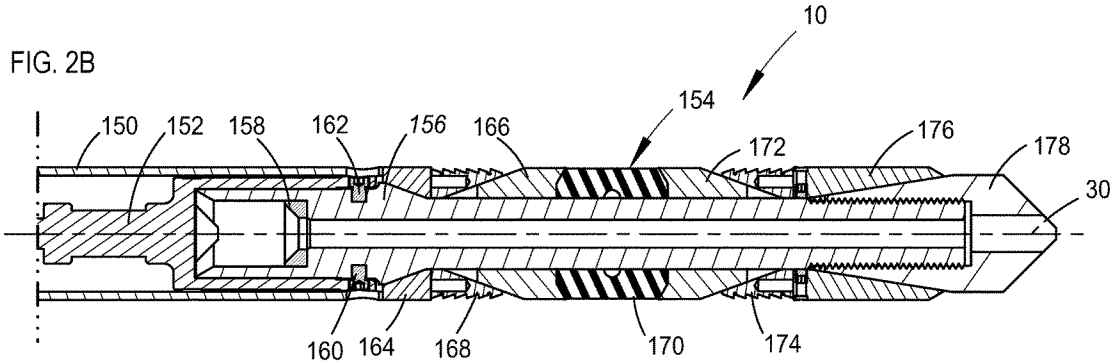

FIGS. 2A and 2B are a longitudinal section view of the well tool string 10 of FIG. 1. A mandrel 18 provides a central, stationary member for the setting tool 12, which extends from the firing head adapter 14 to the lowermost end of the setting tool 12. A barrel piston 16 is slidably mounted to a mandrel 18 and threadingly secured on an upper end to a retainer ring 20. The retainer ring 20 has a shear screw 22 threadingly secured to the retainer ring 20. The shear screw 22 is preferably formed of brass and extends from the retainer ring 20 into the mandrel 18 to hold the barrel piston in a run-in position shown in FIG. 1 until the setting tool 12 is moved into the set position shown in FIG. 2. When the setting tool 12 is operated, the shear screw 22 will separate into two parts 22*a* and 22*b* (shown in FIG. 5), preferably at 2500 pounds force, releasing the barrel piston 16 to move downward over the mandrel 18. The shear screw 22 prevents the weight of a well tool being set from pulling the barrel piston 16 downward on the mandrel 18. The retainer ring 20 will prevent the barrel piston 16 from sliding completely over the mandrel 18. The setting tool 12 preferably has a centrally disposed, longitudinal axis 30 about which the firing head adapter 14, the barrel piston 16, the mandrel 18, and the retainer ring 20 concentrically extend.

The setting tool 12 is self-venting during use. A vent port 24 extends through a sidewall of the barrel piston 16, and a blow out plug 26 which is preferably formed of plastic and disposed within the vent port 24 with a press fit. When the setting tool 12 is actuated, the barrel piston 16 will move downward over the mandrel until the vent port passes over the O-rings 86 in the seal gland grooves 84 and adjacent to the space 94, and pressure from the power charge 74 in the space 94 will then push the blow out plug 26 out of the vent port 24 to vent the power charge gases from the space 94 and the power charge chamber 68.

The setting sleeve 150 has an upper end which is threadingly secured to the exterior threads 142 on the lower end 134 of the barrel piston 16 in conventional fashion. A plug mandrel adapter 152 has an upper end which is threadingly secured to the interior threads 102 of the blind hole 100 formed into the lower section 96 of the mandrel 18. A lower end of the mandrel adapter 152 is preferably secured by brass shear screws 162 to a plug mandrel 156. Preferably, eight shear screws 162 are used. The frac plug 154 preferably includes the plug mandrel 156 which has a ball seat 158 formed in the upper end thereof. Shear screw holes 160 are provided for receiving the brass shear screws 162 which secure the plug mandrel adapter 152 to the upper end of the plug mandrel 156. The frac plug 154 further includes an upper ring 164, an upper conical sleeve 166, and an upper slip assembly 168 which slidably engages with the upper conical sleeve 166 to anchor an upper end of the frac plug 154 to a well casing. A lower slip assembly 174 slidably engages a lower conical sleeve 172 to anchor a lower end of the frac plug 154 to the casing. An elastomeric seal element 170 is disposed between the upper conical sleeve 166 and the lower conical sleeve 172 for compressing there-between to seal between an exterior surface of the plug mandrel 156 and the interior surface of the casing. A bottom sleeve 176 with a bullnose 178 are secured to the lower end of the plug mandrel 156.

Figure 3A:
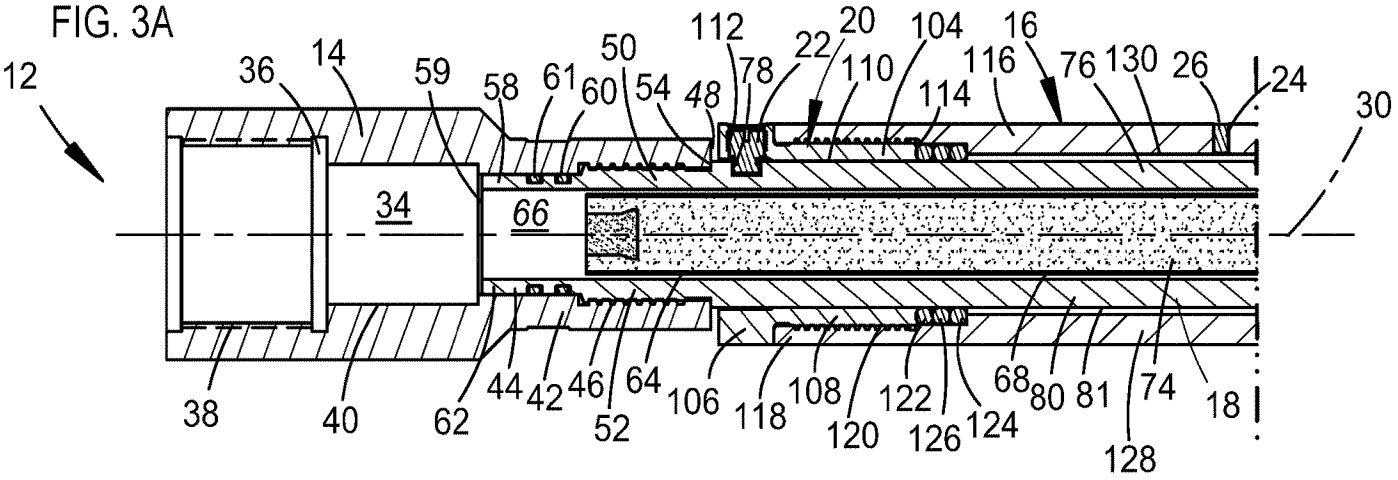
FIGS. 3A and 3B are a longitudinal section view of the disposable setting tool shown in a run-in position.
Figure 3B:
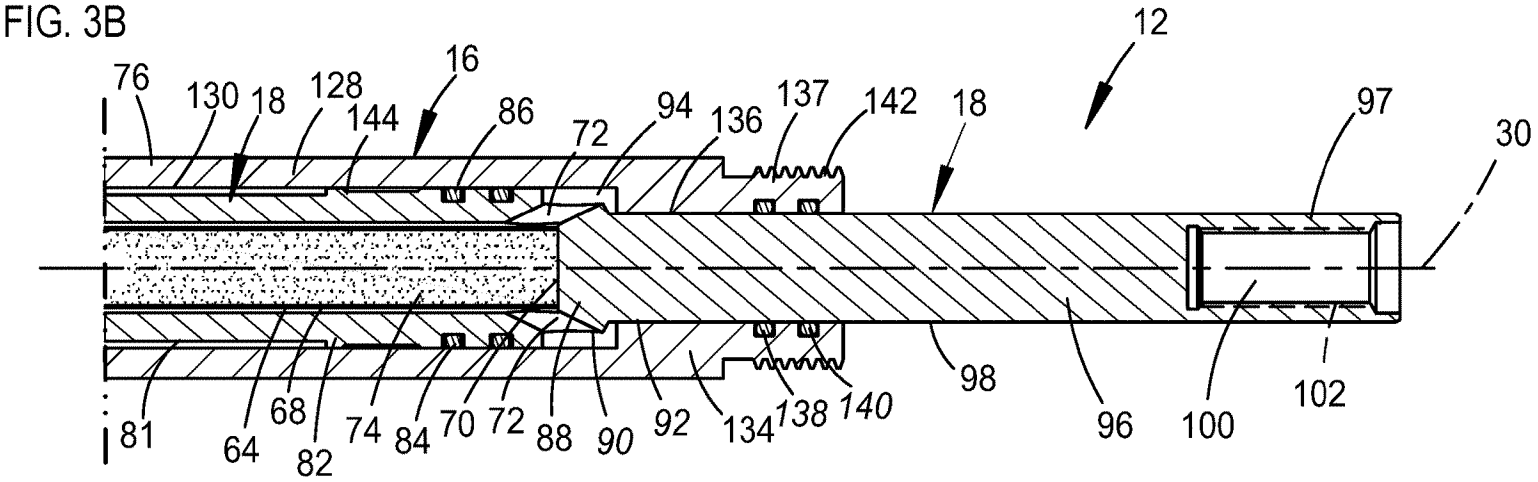

FIGS. 3A and 3B are a longitudinal section view of the disposable setting tool 12 shown in a run-in position. The firing head adapter 14 has an interior bore 34 with an upper box end 36, preferably for receiving an industry standard firing head. The upper box end 36 has a threaded upper end 38 for securing the firing head and an intermediate seal surface 40. The firing head adapter 14 further includes a lower box end 42 for receiving an upper pin end 52 of the mandrel 18. The lower box end 42 includes a seal surface 44 and interior threads 46. A lower terminal end 48 engages a stop 54 which outwardly protrudes from the mandrel 18. In other embodiments, the firing head adapter 14 may be replaced by an industry standard firing head which secures directly to the upper pin end 52 of the mandrel 18.

The mandrel 18 has an upper section 50, an intermediate section 76, a transition section 88 and lower section 96. The upper section 50 includes the upper pin end 52 and defines a first section for the mandrel 18. The upper pin end 52 includes a seal section 58, an intermediate section 56 with exterior threads, and the stop 54. The stop 54 extends radially outward from the pin end 52 with an annular shape which engages lower terminal end 48 of the firing head adapter 14 to space apart an upper terminal end of the mandrel 18 from the intermediate seal surface 40 of the upper box end 36 of the firing head adapter 14. The intermediate section 56 threadingly secures to the interior threads 46 of the lower box end 42 of the firing head adapter 14. The seal section 58 fits within the seal surface 44 and has seal gland grooves 60 for receiving O-rings 61 which are squeezed between the grooves 60 and the seal surface 44. An upper terminal end 59 of the upper pin end 52 is spaced apart from the seal gland grooves 60 to protect the O-rings 61 from heat of combustion when a power charge 74 is burned to power operation of the setting tool 12.

A bore 64 extends interiorly within the mandrel 18, preferably concentric with the longitudinal axis 30. The bore 64 has an ignitor section 66 and a power charge chamber 68. The ignitor section 66 defines an upper terminal end portion of the bore 64, and provides a space for receiving a power charge ignitor. The power charge chamber 68 extends through the intermediate section 76 of the mandrel 18 to a blind end 70 defined on the lowermost end of the chamber 68. Two flow ports 72 extend from the blind end 70 of the power charge chamber 68 to an exterior of the mandrel 18 disposed adjacent to the transition section 88. The two flow ports 72 preferably extend radially outward from a lower end of the power charge chamber 68, with the ports 72 preferably having axes which are angularly disposed one hundred and eighty degrees apart around the longitudinal axis 30.

The intermediate section 76 of the mandrel 18 has an upper end, a central portion defined by an intermediate exterior 80, and a lower end 82. A shear screw hole 78 is provided by a blind hole formed into the upper end of the intermediate section 76 for receiving the shear screw 22. The central portion 80 of the intermediate section 76 has an intermediate exterior 81 of uniform circumference. The lower end 82 defines an upset in the exterior of the mandrel 18 which is of a larger diameter than the central portion 80 to engage the interior of the retainer ring 20 to prevent the barrel piston 16 from passing completely over the lower section 96 of the mandrel 18. Seal gland grooves 84 are formed into the exterior of the lower end 82 for receiving O-rings 86, which seal against an interior surface of the barrel piston 16.

The transition section 88 of the mandrel 18 changes the size of the exterior of the mandrel 18 in two places, reducing in size in a downward direction. The transition section 88 has a first exterior 90 with a first circumference, and a second exterior 92 having a second circumference. The reduced circumferences of the exterior 90 and exterior 92 create an annular-shaped space 94 extending between the mandrel 18 and the interior of the barrel piston 16. The two flow ports 72 extend into the annular-shaped space 94 at the first circumference 90. The annular-shaped space 94 extends downward to an end face 132 on an interior of the barrel piston 16.

The lower section 96 of the mandrel 18 preferably has a solid body of cylindrical shape and defines a second section for the mandrel 18. The exterior 98 of the lower section 96 is preferably of uniform circumference to define a seal surface which also provides a bearing surface for engaging a bore 136 of the enclosed lower end 134 of the barrel piston 16. A blind hole 100 is formed into the lowermost end 97 of the mandrel 18 and has interior threads 102 to define a threaded box end for receiving the frac plug mandrel adapter 152 (shown in FIGS. 2A and 2B).

The retainer ring 20 has an annular-shaped body 104 with an upper end portion 106 and a lower end portion 108. The upper end portion 106 has a larger outside diameter than the lower end portion 108. An interior bore 110 of uniform circumference extends through the retainer ring 20 and is sized for slidably extending over the central portion 80 of the intermediate section 76 of the mandrel 18, and engaging the lower end 82 of the mandrel 18 such that the lower end 82 acts as an annular-shaped stop to prevent the retainer ring 20 from passing over the lower end 82. The lower end portion 108 of the retainer ring 20 has exterior threads for securing to an upper end 118 of the barrel piston 16. The upper end portion 106 has a shear screw hole 112 which extends radially through the retainer ring, transverse or orthogonal to the longitudinal axis 30. The shear screw hole 112 is threaded for securing the shear screw 22 thereto. In the run-in position, the shear screw hole 112 is aligned to register with the shear screw hole 78 in the intermediate section 76 of the mandrel 18, defining the position of the barrel piston 16 relative to the mandrel 18 in the run-in position. The retainer ring 20 has a lowermost terminal end 114 defining an upper end of a shock ring section 122.

The barrel piston 16 has a tubular body 116 with an open upper end 118, a central portion 128 and an enclosed lower end 134. The upper end 118 has a threaded section 120 with interior threads which threadingly engage the exterior threads of the lower end portion 108 of the retainer ring 20 to secure the mandrel 18 to the retainer ring 20. A shock ring section 122 is defined by an interior annular-shaped recess which extends into the interior surface of the upper end 118 of the mandrel 18 between a stop end 124 and the lowermost terminal end 114 of the retainer ring 20. The stop end 124 defines the lowermost of the shock ring section 122. Preferably, three O-rings 126 are disposed in the shock ring section 122 to absorb shock when shear pings for securing a mandrel adapter to a plug being set are sheared, and the barrel piston 16 bottoms out on the upset formed on the lower end 82 of the mandrel 18. The central portion 128 has an interior surface 130 of uniform circumference and defines an outer cylindrical portion of the annular-shaped space 94. The annular space 94 has an end face 132, which is annular-shaped and which the pressure within the space 94 acts against when the tool is operated to move from the run-in position to the set position. The enclosed lower end 134 of the mandrel 18 has the bore 136 extending centrally through the end 134, concentrically disposed with the longitudinal axis 30. The bore 136 provides an interior bearing surface for slidably engaging the exterior surface 98 of the lower section 96 of the mandrel 18. Seal gland grooves 138 are formed into the bore 136 for receiving O-rings 140. Exterior threads 142 are provided on the lowermost end 137 of the barrel piston 16.

Figure 4:
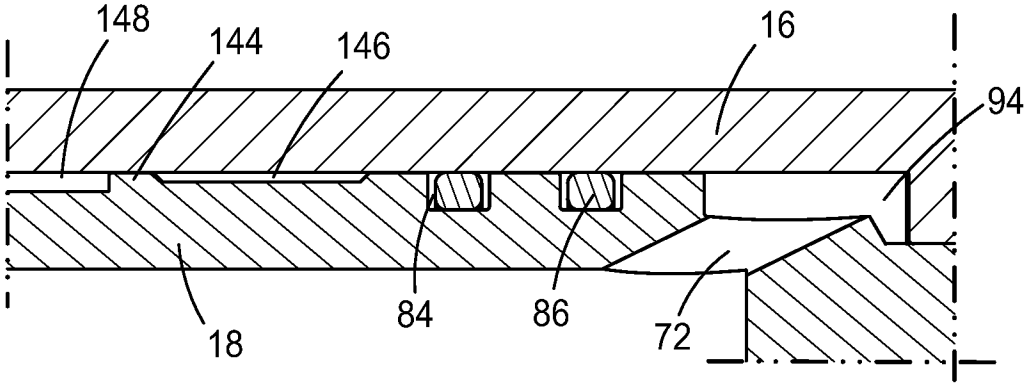

FIG. 4 is an enlarged, partial section view of the mandrel 18 and the barrel piston 16 of the disposable setting tool 12. An annular-shaped tab 144 is defined in the lower end 84 of the mandrel 18, and provides as stop for the upper end 118 of the barrel piston 16. The O-rings 126 in the shock ring section 122 will engage the annular-shaped tap 144. A recess 146 is defined between the annular-shaped tab 144 and the seal gland grooves 84, providing a relief section in the exterior of the mandrel 18. An annular shaped space 148 extends between the interior 130 of the barrel piston 16 and the central portion 80 of the intermediate section 76 of the mandrel 18, from the annular-shaped tab 144 to the O-rings 126 of the shock section 122.

Figure 5:
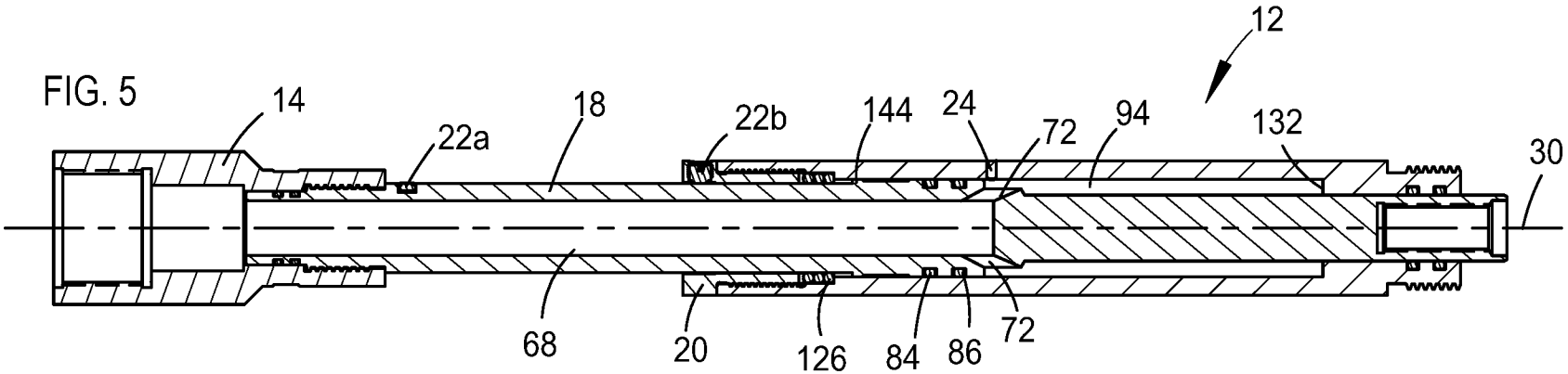

FIG. 5 is a longitudinal section view of the disposable setting tool 12 shown in a set position. The power charge 74 will be ignited and burn, generating high pressure gas which passes through the two ports 72 and builds pressure within the space 94. Force from the pressure will press against the end face 132, shearing the shear screw 22 into two halves 22*a* and 22*b*. Then the barrel piston 16 will move downwards to set the frac plug 154, until the vent port 24 passes over the O-rings 86 and is exposed to the pressure in the space 94. The pressure in the space 94 will blow the plug 26 from the vent port 24 and the pressure will be relieved from within the space 94 and the power charge chamber 68.

Various components of the disposable setting tool 12 are formed of steel, preferably of lower cost steel to reduce the costs. In other embodiments, components of the disposable setting tool are formed of composite materials.

The power charge chamber 68 is preferably of a size having an interior diameter which is not larger than forty percent (40%) of the exterior diameter of the central portion 80 of the mandrel 18. If the interior of the power charge chamber 68 or exterior of the central portion 80 of the mandrel 18 are not round, then a ratio of effective cross-sectional areas calculated from the cross-sectional areas of the power charge chamber 68 or the central portion 80 will preferably be used to determine that the maximum size of the power charge chamber 68 as compared to the exterior of the central body portion portion 80 of the mandrel 18. The power charge 74 is preferably of a size which extends substantially the full length of the power charge chamber 68, preferably at least ninety percent of the length of the power charge chamber 68, and which has an exterior diameter which is no smaller then seventy-five percent (75%) of the interior diameter of the power charge chamber 68. If the power charge chamber 68 or the power charge 74 are of a shape other than cylindrical, then the effective diameter of the power charge 74 should be compared to the effective diameter of the power charge chamber 68, with the effective diameters determined by calculation from the cross-sectional areas of the power charge chamber 68 and the power charge 74. Preferably, the power charge 74 is type of power charge which burns at a rate such that combustion takes fifteen to sixty seconds.

In operation, the power charge 74 located in the setting tool 12 is burned to create pressurized gases which press pass from the power charge chamber 68 through the flow ports 72 and into the annular-shaped space 94. The pressurized gases then press against the end face 132 to separate the shear screw 22, and push the barrel piston 16 downward to set the frac plug 154 in conventional fashion. The plastic seal plug 26 will blow out of the vent port 24 when the vent port 24 travels past the O-rings 86 in the seal gland grooves 84, when the vent port 24 is exposed to the pressure within the annular shaped space 94. The vent port 24 will then vent the pressurized gasses from within the space 94 to the well. The setting tool 12 is preferably dry fired, using only a power charge and not using a hydraulic fluid such as oil, which is used in conventional setting tools. Since lower cost materials are used in the setting tool 12, it costs much less than conventional oil filled well tool setting tools and may be disposed of after a single use.

The present invention provides advantages of a low cost setting tool which may be disposed of after one use. Since the tool is dry fired, without use of hydraulic fluid such as oil, the tool may be disposed of without requiring tearing down of the tool for removal of hydraulic fluids. The disposable setting tool also eliminates rebuilding of the setting tool for later use, reducing risks the tool not being properly rebuilt during field dressing and eliminating the labor costs for field operators to field dress the tool.

Although the preferred embodiment has been described in detail, it should be understood that various changes, substitutions and alterations can be made therein without departing from the spirit and scope of the invention as defined by the appended claims.

What is claimed is:

1. A gas operated setting tool for use in wells, comprising:

a mandrel having a first section, an intermediate section and a second section, said first section of being defined for securing to a firing head thereto, said intermediate section having an interior bore extending from said first section to a blind end of said interior bore and defining a power charge chamber, wherein one or more flow ports extend radially outward from said power charge chamber through said mandrel to an exterior of said intermediate section of said mandrel, said intermediate section defining an intermediate exterior of a first uniform circumference, and said second section having a lower exterior of a second uniform circumference, wherein said lower exterior is in fluid communication with said interior bore;

a barrel piston having a tubular body with an enclosed end, said tubular body having a central portion with a uniform interior circumference for slidably receiving said intermediate section and said second section of said mandrel, with an annular-shaped space defined to extend between said central portion of said tubular body of said barrel piston and said second section of said mandrel, said enclosed end of said tubular body having a bore for slidably receiving said second section of said mandrel;

a first seal extending between said tubular body of said barrel piston and said intermediate section of said mandrel for sealing a first portion of said annular-shaped space;

a second seal extending between said bore in said enclosed end of said barrel piston and said second section of said mandrel for sealing a second portion of said annular-shaped space;

said mandrel further having an upper end with a seal section for securing to the firing head, and wherein said mandrel and said barrel piston have lowermost ends adapted for securing to respective ones of a setting sleeve and a packer mandrel; and wherein a power charge is disposed in said power charge chamber and ignited to generate pressurized gas, pass said pressurized gas through said one or more ports and stroke said barrel piston over said second section of said mandrel, moving the setting sleeve relative to the packer mandrel and setting a well tool secured thereto.

2. The gas operated setting tool according to claim 1, wherein the mandrel further comprises a transition section having a first exterior disposed adjacent to said intermediate exterior and having a first circumference which is smaller than said first uniform circumference of said intermediate exterior, and second exterior disposed adjacent to said first exterior and adjacent to said exterior of said second section of said mandrel, wherein said second exterior has a second circumference which is smaller than said first circumference.

3. The gas operated setting tool according to claim 2, wherein said second circumference is adjacent to and the same size as said second uniform circumference of said second exterior of said second section of said mandrel.

4. The gas operated setting tool according to claim 2, wherein one or more flow ports comprise two ports which extend through said mandrel, from said power charge chamber to said first exterior of said transition section.

5. The gas operated setting tool according to claim 1, wherein said barrel piston is adapted for securing to the setting sleeve and said mandrel is adapted for securing to the packer mandrel.

6. The gas operated setting tool according to claim 5, wherein, when the power charge is ignited to generate the pressurized gas, the mandrel and the packer mandrel are stationary and the barrel piston is stroked downward over said mandrel to move said setting sleeve downward over said packer mandrel.

7. The gas operated setting tool according to claim 6, wherein said gas operated setting tool is dry fired, such that the pressurized gas from the power charge acts directly on said barrel piston which pushes directly on the setting sleeve without hydraulic fluid there-between.

8. The gas operated setting tool according to claim 1, wherein a shear screw is secured to one of said barrel piston and said mandrel, and extends into the other of said barrel piston and said mandrel to prevent movement of said barrel piston relative to said mandrel until the power charge is ignited.

9. The gas operated setting tool according to claim 1, further comprising a vent port which extends through a side of said barrel piston for venting said annular-shaped space and said power charge chamber when said barrel piston is stroked over said second section of said mandrel and said vent port is aligned in fluid communication with said annular-shaped space.

10. A gas operated setting tool for use in wells, comprising:

a mandrel having an upper end, an intermediate section and a lower section, said upper end being defined for securing to a firing head thereto, said intermediate section having an interior bore extending from said first section to a blind end of said interior bore and defining a power charge chamber, wherein one or more flow ports extend radially outward from said power charge chamber through said mandrel to an exterior of said intermediate section of said mandrel, and said intermediate section further defining an intermediate exterior of a first uniform circumference, and said lower section having a lower exterior of a second uniform circumference, wherein said second uniform circumference of said lower exterior of said lower section is smaller than said first uniform circumference of said intermediate exterior of said intermediate section;

a barrel piston having a tubular body with an enclosed lower end, said tubular body having a central portion with a uniform interior circumference for slidably receiving said intermediate section and said lower section of said mandrel, with an annular-shaped space defined to extend between said central portion of said tubular body of said barrel piston and said lower section of said mandrel, said enclosed lower end of said tubular body having a bore which is smaller in circumference than said uniform interior circumference of said central portion and sized for slidably receiving said lower section of said mandrel;

wherein one or more flow ports extend through said mandrel, from said power charge chamber of said interior bore to said annular-shaped space between said barrel piston and said mandrel, such that said lower exterior is in fluid communication with said power charge chamber;

a first seal extending between said barrel piston and said intermediate section of said mandrel for sealing an upper portion of said annular-shaped space;

a second seal extending between said bore in said enclosed lower end of said barrel piston and said lower section of said mandrel for sealing a lower portion of said annular-shaped space;

said upper end of said mandrel having a seal section for securing to the firing head, and wherein said mandrel and said barrel piston have lowermost ends adapted for securing to respective ones of a setting sleeve and a packer mandrel; and wherein a power charge disposed in said power charge chamber is ignited to generate pressurized gas and stroke said barrel piston over said lower section of said mandrel, moving the setting sleeve relative to the packer mandrel and setting a well tool secured thereto.

11. The gas operated setting tool according to claim 10, wherein the mandrel further comprises a transition section having a first exterior disposed adjacent to said intermediate exterior and having a first circumference which is smaller than said first uniform circumference of said intermediate exterior, and a second exterior disposed adjacent to said first exterior and adjacent to said exterior of said lower section of said mandrel, wherein said second exterior has a second circumference which is smaller than said first circumference.

12. The gas operated setting tool according to claim 11, wherein said one more flow ports comprise two ports which extend for fluid communication with said annular-shaped space at said first exterior of said transition section.

13. The gas operated setting tool according to claim 11, wherein said second circumference is adjacent to and the same size as said second uniform circumference of said lower exterior of said lower section of said mandrel.

14. The gas operated setting tool according to claim 10, wherein said barrel piston is adapted for securing to the setting sleeve and the mandrel is adapted for securing to the packer mandrel.

15. The gas operated setting tool according to claim 14, wherein said gas operated setting tool is dry fired, such that the pressurized gas from the power charge acts directly on said barrel piston which pushes directly on the setting sleeve without hydraulic fluid there-between.

16. The gas operated setting tool according to claim 10, wherein a shear screw is secured to one of said barrel piston and said mandrel, and extends into the other of said barrel piston and said mandrel to prevent movement of said barrel piston relative to said mandrel until the power charge is ignited.

17. The gas operated setting tool according to claim 10, further comprising a vent port which extends through a side of said barrel piston for venting said annular-shaped space and said power charge chamber when said barrel piston is stroked over said lower section of said mandrel and said vent port is aligned in fluid communication with said annular-shaped space.

18. A gas operated setting tool for use in wells, comprising:

a mandrel having an upper end, an intermediate section and a lower section, said mandrel being concentrically disposed about a central longitudinal axis, said upper end of said mandrel being defined for securing to a firing head thereto, said intermediate section having an interior bore extending from said first section to a blind end of said interior and defining a power charge chamber, wherein two flow ports extend radially outward from said power charge chamber through said mandrel to an exterior of said intermediate section of said mandrel, and said intermediate section further defining an intermediate exterior of a first uniform circumference, and said lower section having a lower exterior of a second uniform circumference, wherein said second uniform circumference of said lower exterior of said lower section is smaller than said first uniform circumference of said intermediate exterior of said intermediate section;

a barrel piston having a tubular body with an enclosed lower end, said tubular body having a central portion with a uniform interior circumference for slidably receiving said intermediate section and said lower section of said mandrel, with an annular-shaped space defined to extend between said central portion of said tubular body of said barrel piston and said lower section of said mandrel, said enclosed lower end of said tubular body having a bore which is smaller in circumference than said uniform interior circumference of said central portion and sized for slidably receiving said lower section of said mandrel;

said mandrel further having a transition section disposed adjacent to said intermediate exterior and adjacent to said exterior of said lower section of said mandrel, wherein said two flow ports extend through said mandrel at said transition section, from said power charge chamber of said interior bore to said annular-shaped space between said barrel piston and said mandrel, such that said lower exterior is in fluid communication with said power charge chamber;

a first seal extending between said barrel piston and said intermediate section of said mandrel for sealing an upper portion of said annular-shaped space;

a second seal extending between said bore of said enclosed lower end of said barrel piston and said lower section of said mandrel for sealing a lower portion of said annular-shaped space;

said upper end of said mandrel having a seal section for securing to the firing head, and wherein said mandrel and said barrel piston have lowermost ends adapted for securing to respective ones of a setting sleeve and a packer mandrel;

wherein a power charge is disposed in said power charge chamber and ignited to generate pressurized gas and stroke said barrel piston over said lower section of said mandrel, moving the setting sleeve relative to the packer mandrel and setting a well tool secured thereto; and wherein said gas operated setting tool is dry fired, such that the pressurized gas from the power charge acts directly on said barrel piston which pushes directly on the setting sleeve without hydraulic fluid there-between.

19. The gas operated setting tool according to claim 18, wherein said barrel piston is adapted for securing to the setting sleeve and the mandrel is adapted for securing to the packer mandrel, and wherein, when the power charge is ignited to generate the pressurized gas, the mandrel and the packer mandrel are stationary and the barrel piston is stroked downward over said mandrel to move said setting sleeve downward over said packer mandrel.

20. The gas operated setting tool according to claim 19, further comprising a shear screw which is secured to one of said barrel piston and said mandrel, and extends into the other of said barrel piston and said mandrel to prevent movement of said barrel piston relative to said mandrel until the power charge is ignited; and a vent port which extends through a side of said barrel piston for venting said annular-shaped space and said power charge chamber when said barrel piston is stroked over said lower section of said mandrel and said vent port is aligned in fluid communication with said annular-shaped space.

* * * * *